US007948834B2

(12) United States Patent
Schrock et al.

(10) Patent No.: US 7,948,834 B2
(45) Date of Patent: May 24, 2011

(54) PACE CALCULATION WATCH

(75) Inventors: Allan M. Schrock, Portland, OR (US); Edward L. Boyd, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 12/773,220

(22) Filed: May 4, 2010

(65) Prior Publication Data

US 2010/0217559 A1 Aug. 26, 2010

Related U.S. Application Data

(63) Continuation of application No. 10/086,644, filed on Feb. 28, 2002, now Pat. No. 7,710,834.

(51) Int. Cl.
*G04F 8/00* (2006.01)

(52) U.S. Cl. ..... 368/110

(58) Field of Classification Search ..... 368/46–84, 368/107–113

See application file for complete search history.

(56) References Cited

U.S. PATENT DOCUMENTS 4,220,996 A 9/1980 Searcy
4,337,529 A 6/1982 Morokawa
4,962,469 A 10/1990 Ono et al.
5,050,141 A 9/1991 Thinesen
5,297,110 A 3/1994 Ohira et al.
5,301,154 A 4/1994 Suga
5,526,290 A * 6/1996 Kanzaki ..... 702/160
5,771,399 A 6/1998 Fishman
6,212,469 B1 * 4/2001 Knepper ..... 701/201
6,219,303 B1 * 4/2001 Morohoshi et al. ..... 368/47
6,414,907 B1 * 7/2002 Pennington ..... 368/10

* cited by examiner

*Primary Examiner* — Edwin A. Leon

(74) *Attorney, Agent, or Firm* — Banner & Witcoff, Ltd.

(57) ABSTRACT

A watch that advantageously allows an athlete, such as a runner, to conveniently and instantly calculate a pace at which a distance was traveled. The watch includes a chronographic process and a pace calculation process. In order to determine a pace, the athlete enters the travel distance into the pace calculation process. The athlete then initiates a count by the chronographic process when he or she starts traveling the designated distance. When the athlete finishes traveling the designated distance, he or she stops the count, so that the chronographic process measures the total elapsed time required to travel the designated distance. The pace calculation process then obtains the total elapsed time from the chronographic process, and divides the designated travel distance by the total elapsed time to calculate the pace at which the distance was traveled.

22 Claims, 5 Drawing Sheets

PACE CALCULATION WATCH

RELATED APPLICATION DATA

This application is a continuation of U.S. patent application Ser. No. 10/086,644 filed Feb. 28, 2002 in the name of Allan M. Schrock, et al., and entitled "Pace Calculation Watch" (now U.S. Pat. No. 7,710,834), which application is entirely incorporated herein by reference.

FIELD OF THE INVENTION

The invention relates to a watch that calculates a pace. More particularly, the invention relates to a watch that has a chronographic function and accepts distance data from a user. With the input distance data and an elapsed time measured by the chronographic function, the watch determines the pace at which the distance was traversed.

BACKGROUND OF THE INVENTION

In order to measure their performance in a quantifiable manner, athletes will often measure various time parameters corresponding to their travel over a distance. For example, a runner may measure the total elapsed time required to run a distance, the elapsed time required to run a segment of the distance, and/or the average time required to run equal segments of the distance. Likewise, cyclists, ice skaters, sailors, hikers, swimmers, skiers, and other athletes may desire to measure the total elapsed time required to run a distance, the elapsed time required to run a segment of the distance, and/or the average time required to run equal segments of the distance.

To address the needs of such athletes, some watchmakers manufacture watches that include a chronograph. A chronograph measures and records time periods, and thus permits an athlete to measure the total amount of time elapsed while traveling a desired distance. An athlete can start the chronograph counting when he or she begins traveling the distance, and stop the chronograph counting when he or she has completed traveling the distance. The time counted on the chronograph is the total amount of time that elapsed while the distance was traveled.

Some watches include chronographs that also allow a user to measure individual subsets of the overall time period without stopping or resetting the count. These time segments are sometimes referred to as "split" times. Thus, chronographs that measure split times allow a runner to additionally record the amount of time that has elapsed at any point during the run. For example, a runner may want to measure the total time he or she takes to run four laps around a track. If a runner also measures a split time at the completion of each lap, the first split time will be the total time required to run the first lap, the second split time will be the total time required to run both the first lap and the second lap, and the third split time will be the total time required to run all of the first three laps.

Still further, some watches include a second chronograph that allows a user to initiate one or more additional counts without resetting the count of the primary chronograph. Using this feature with the above example, a runner can measure the time elapsed to run around any single lap without resetting the count for the total elapsed time required to complete all four laps. With some watches, the second chronograph is configured to reset when the runner measures a split time with the primary chronograph. This allows a runner to conveniently measure the time difference between one split time and its subsequent split time. These individual time measurements are sometimes referred to as "lap" times.

Another particularly useful time parameter many athletes measure is the pace or speed at which they travel a selected distance. Measuring a pace allows an athlete to accurately determine whether or not he or she is traveling faster or slower than a desired speed. A runner may wish to have this information in order to, for example, determine whether his or her current pace will allow him or her to be competitive in a race, burn a desired number of calories for a run of a set time, or be able to complete a run in an allotted time. Unfortunately, however, even watches with chronographs do not allow an athlete to easily measure the pace of travel over a particular distance. Instead, a user must manually calculate the pace using the total elapsed time of travel provided by the chronograph. In order to immediately determine a pace, an athlete must either carry a calculator or pen and paper to make the calculation, which is cumbersome. Alternately, the athlete must record the total elapsed time counted by the chronograph, and calculate the pace later. Accordingly, it would be desirable to allow an athlete to conveniently calculate a pace immediately after traveling a distance.

SUMMARY OF THE INVENTION

The invention advantageously allows an athlete, such as a runner, to conveniently and instantly calculate a pace at which a distance was traveled. A watch according to the invention includes a chronographic process and a pace calculation process. In order to determine a pace, the athlete enters the travel distance into the pace calculation process. The athlete then initiates a count by the chronographic process when he or she starts traveling the designated distance. When the athlete finishes traveling that distance, he or she stops the count, so that the chronographic process measures the total elapsed time required to travel the designated distance. The pace calculation process then obtains the total elapsed time from the chronographic process, and divides the designated travel distance by the total elapsed time to obtain the pace at which the distance was traveled. Thus, the invention automatically and immediately provides the athlete with the pace at which the designated distance was traveled.

These and other features and aspects of the invention will be apparent upon consideration of the following detailed description of the preferred embodiments.

DETAILED DESCRIPTION OF PREFERRED EMBODIMENTS

Figure 1:
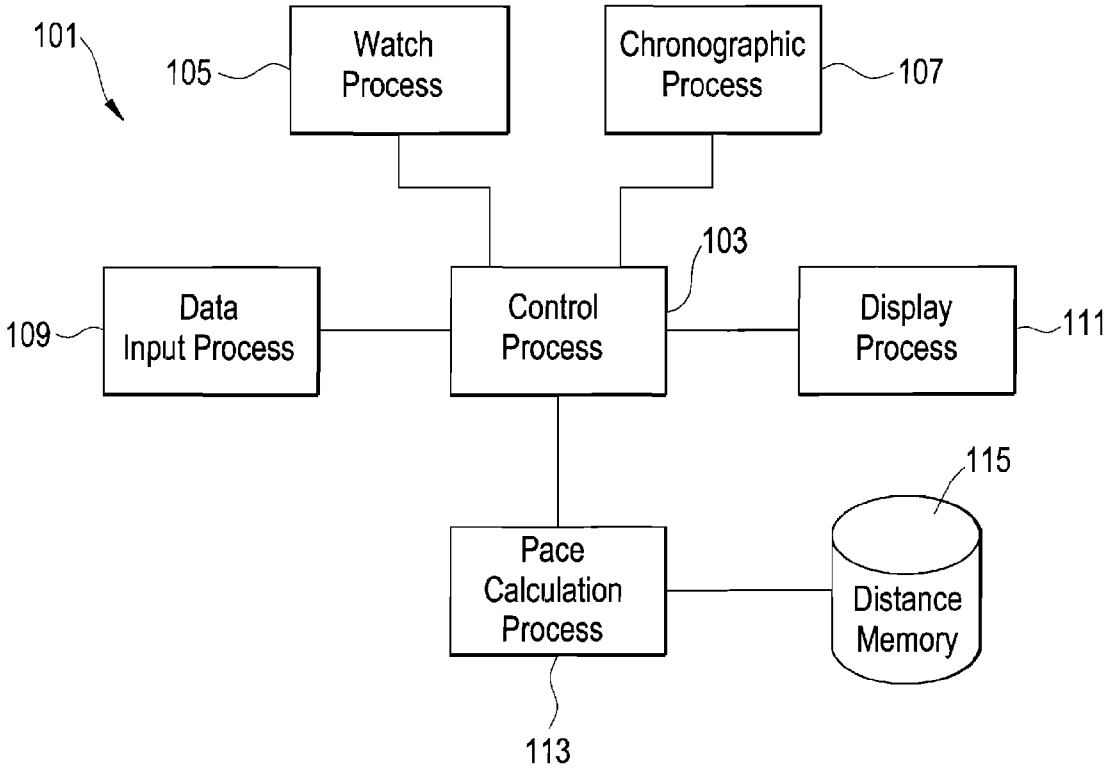
FIG. 1 is a block diagram of components of a watch according to one embodiment of the invention.

FIG. 1 illustrates components of a watch according to one embodiment of the invention. As seen in this figure, a watch 101 includes a control process 103, a watch process 105, and a chronographic process 107. As will be appreciated by those of ordinary skill in the art, the watch process 105 provides a chronometer that sequentially counts the hours, minutes and seconds during a 12 or 24 hour time period, resetting itself to 1:00:00 at the end of each period. The watch process 105 also may include a calendar that counts the month, date, year and day of the week. As is customary, the user of watch 101 will set the value of the counter and calendar to correspond with the current time in a desired time zone.

The chronographic process 107, also well known in the art, provides a primary chronograph (referred to hereafter for convenience as a "counter") that, when activated, sequentially counts the elapsing hours, minutes, seconds and hundredths of a second. Unlike the counter for the watch process 105, the counter for the chronographic process 107 resets to 0:00:00:00, so that it may measure a total elapsed time for a desired time period. With the illustrated embodiment of the invention, the chronographic process 107 allows a user to measure split times with the primary chronograph. The chronographic process 107 also provides a second counter for counting lap times (that is, the time difference between sequential split times).

The watch 101 also includes a data input process 109 and a display process 111. As conventionally known, the display process 111 may display the current time recorded by the watch process 105, an elapsed time measured by the chronographic process 107, or both. The display process 111, as will be explained below, also may be used to display other information entered into or determined by the watch 101. The data input process 109 receives data provided by the user of the watch 101. For example, the data input process 109 receives data necessary to set the chronometer of the watch process 105 to the current time within the desired time zone. The data input process 109 also receives input commands to start and stop the primary and secondary counters of the chronographic process 107. Still further, the data input process 109 receives commands instructing the display process 111 to display different data values determined by the watch 101. The control process 103 then coordinates the exchange of data between the watch process 105, the chronographic process 107, the data input process 109, the display process 111, and other processes of the watch 101.

The watch 101 also includes a pace calculation process 113 and a distance memory 115. As will be explained in detail below, the distance memory 115 stores travel distance input data provided by a user through the data input process 109. When the pace calculation process 113 receives an elapsed time value from the chronographic process 107, the pace calculation process 113 calculates the pace at which the travel distance was traversed. More particularly, the pace calculation process 113 determines the pace by dividing the travel distance stored in the distance memory 115 by the elapsed time value received from the chronographic process 107.

Each of the control process 103, the watch process 105, the chronographic process 107, the data input process 109, the display process 111 and the pace calculation process 113 may be implemented by software. As will be appreciated by those of ordinary skill in the art, however, one or more of these processes can be implemented using hardware or firmware. Still further, with some embodiments of the invention, at least the watch process 105 or the chronographic process 107 may be implemented using a mechanical structure. For example, the chronographic process 107 may be implemented with a mechanical chronograph. An optical encoder may then be used to provide the elapsed time in a digital format to the pace calculation process 113.

Also, in FIG. 1, the distance memory 115 is illustrated as being connected directly to the pace calculation process 113. It should be noted, however, that this depiction is for convenience only. The distance memory 115 may communicate directly with the pace calculation process 113 as shown. Alternately, the distance memory 115 may provide the stored travel distance data to the pace calculation process 113 through the control process 103 or other intermediary.

Figure 2A:
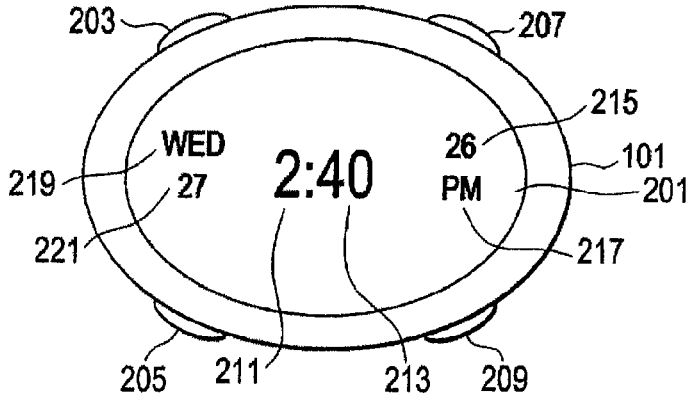
FIGS. 2A-2I illustrate various user interfaces provided a watch according to one embodiment of the invention.
Figure 2B:
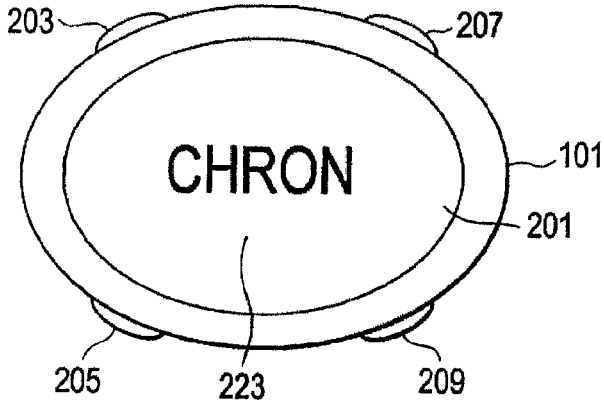
Figure 2C:
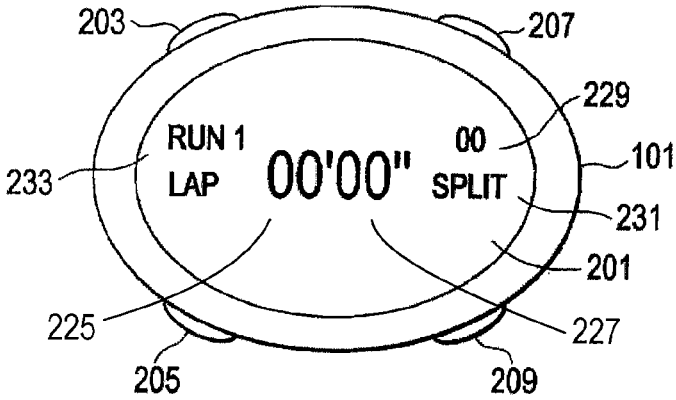
Figure 2D:
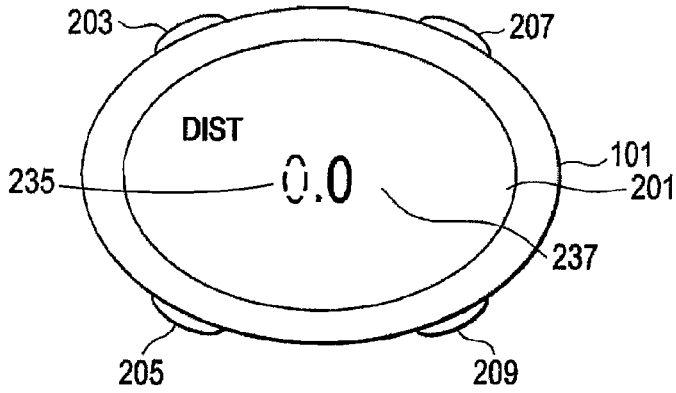
Figure 2E:
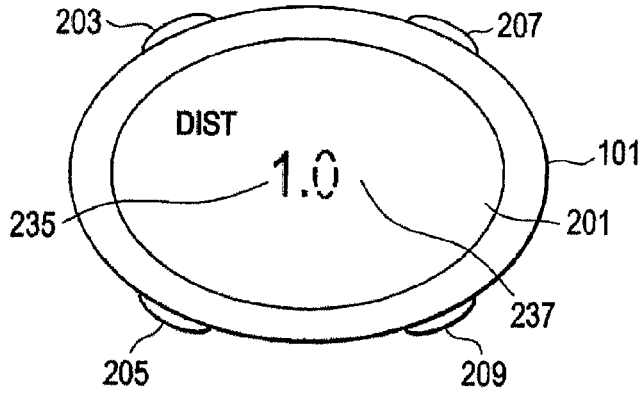
Figure 2F:
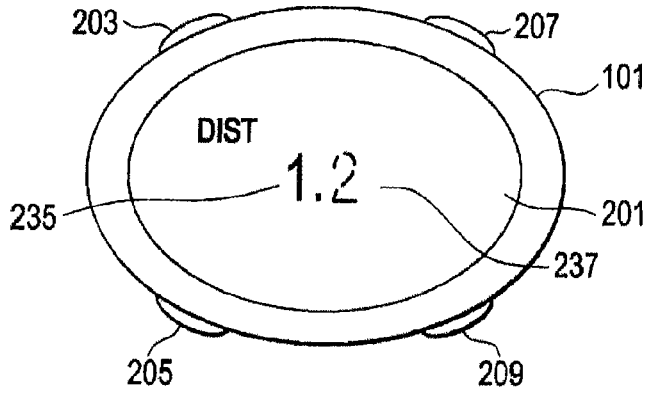
Figure 2G:
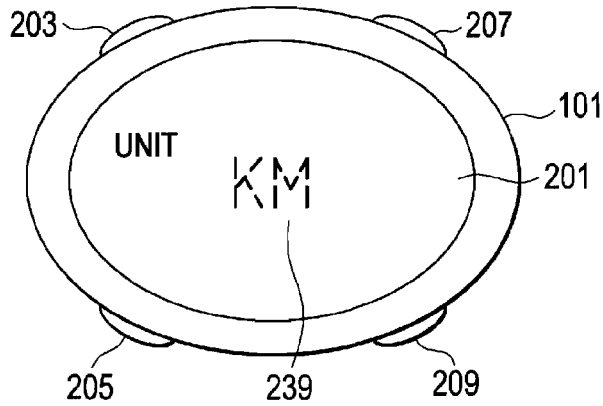
Figure 2H:
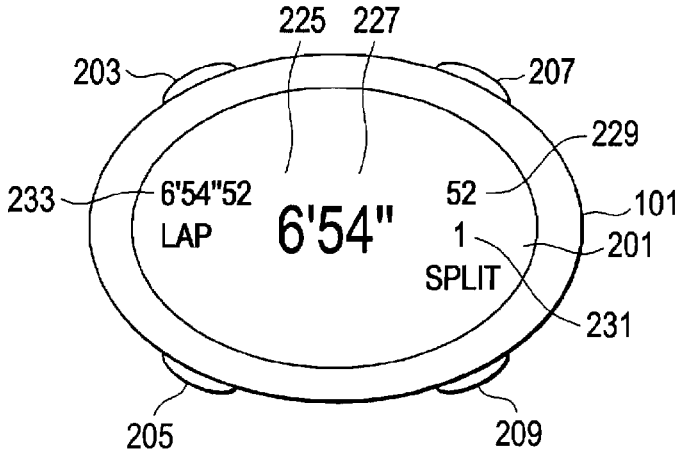
Figure 2I:
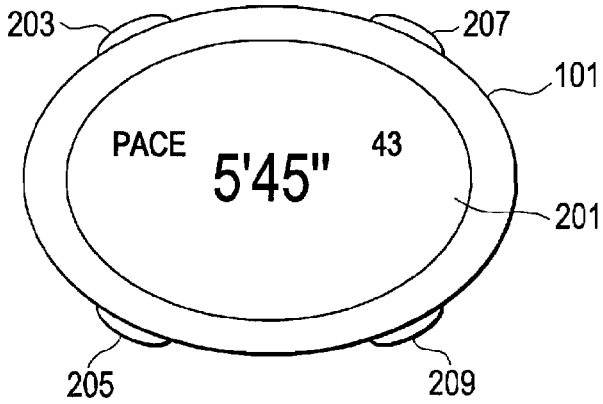
Figure 3:
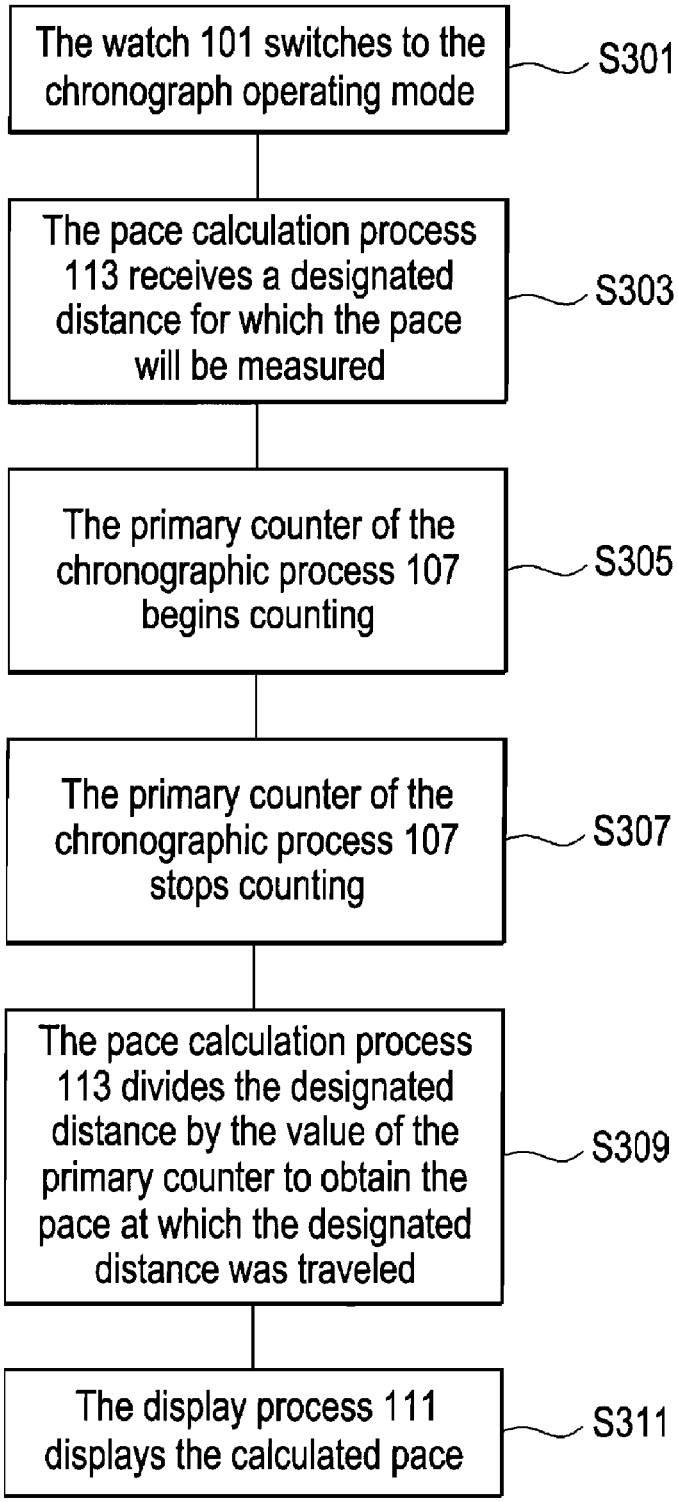
FIG. 3 illustrates a flowchart describing the process by which an embodiment of the invention determines a pace.

FIGS. 2A-2I disclose a watch 101 according to an embodiment of the invention, while FIG. 3 illustrates a flowchart describing the process by which the watch 101 determines a pace. With some embodiments of the invention, the watch 101 is a wristwatch, but with alternate embodiments of the invention the watch 101 may be embodied as a pocket watch or as part of a larger device, such as a personal digital assistant. As seen in FIG. 2A, the watch 101 includes a display 201, which displays data values provided by the display process 111. The watch 101 also includes four input command buttons 203-209. As will be explained in detail below, activating the first input command button 203, referred to as the "mode" command button, allows a user to switch between various operational modes of the watch 101. The second input command button 205, referred to as the "adjust" command button, allows a user to scroll through data fields, or to clear the contents of a selected data field. The third and fourth input command buttons 207 and 209, referred to as the "start" and "stop" command buttons, respectively, are used to start and stop the operation of the counters of the chronographic process 107, and to set the current time for the watch process 105. The command buttons 207 and 209 may also be used to change the value of various data employed by the watch 101, such as the traveled distance data.

As previously noted, the watch 101 has different operational modes, including a "time" mode, a "chronographic" mode, and a "data" mode. In the time mode, the display 201 displays the current time, while in the chronographic mode, the display 201 displays the current values of the primary and secondary counters of the chronographic process 107. In the data mode, the display 201 displays data provided by the chronographic process 107 and the pace calculation process 113, as will be discussed below. Of course, with various embodiments of the invention, the watch 101 may have still other operational modes. For example, the watch 101 may have an "alarm" mode for setting a time to sound an alarm, a "counter" mode for counting integral values, and a "sensor" mode for displaying data received from a remote sensor, such as a heart monitor or an accelerometer.

FIG. 2A illustrates the watch 101 in the time mode. Thus, the display 201 displays a current time value recorded by the watch process 105. More particularly, the display 201 provides an hour field 211 displaying the current hour of time for the selected time zone, a minute field 213 displaying the current minute of time for the selected time zone, a second field 215 displaying the current second of time for the selected time zone, and an A.M./P.M. field 217 indicating whether the values in the fields 211-215 are for an A.M. or P.M. time. The display 201 also provides a date field 219, displaying the current calendar day for the selected time zone (in the illustrated example, Wednesday), and a date field 221 displaying the current date of the month for the desired time zone.

In order to employ the pace calculation process 113 for the illustrated embodiment of the present invention, the user first switches the mode of the watch 101 to the chronograph mode in step 301. As known in the art, a user may sequentially scroll through the various operating modes of the watch 101 simply by activating the mode command button 203 to switch from one operating mode to the next operating mode. When the watch 101 switches to the chronographic mode, the display process 111 will briefly provide a name field 223 displaying the name of that operating mode, as illustrated in FIG. 2B. As the watch 101 continues to operate in the chronographic mode, the chronographic process 107 provides the display process 111 with the current values of the primary and secondary counters. The display 201 then displays these values, as shown in FIG. 2C.

More particularly, the display 201 provides fields 225-229 containing the minutes, seconds, and hundredths of a second, respectively, which have elapsed during a measured time period. As will be appreciated by those of ordinary skill in the art, for some embodiments of the invention, the display 201 may additionally provide an hours field for displaying the number of hours that have elapsed during the measured time period. The display 201 may provide the hours field in addition to, or as a substitute for, the hundredths of a second field 229. With the particular embodiment of the invention shown in FIGS. 2A-2I, the chronographic process 107 allows a user to measure split times. Thus, the display 201 also includes a field 231 for displaying the number of the split time currently being measured. When the chronographic process is recording the first split time (that is, the first measured period), the field 231 displays the value "1." When the chronographic process is recording the second split time, the field 231 displays the value "2," and so forth. As previously noted, the chronographic process 107 also provides a second counter that allows a user to measure and record the elapsed time of individual split time segments, referred to as "lap" times. Accordingly, the display 201 also includes a field 233 for displaying the time elapsed during a lap period.

With the embodiment shown in FIG. 2C, the operation of the primary counter has not yet been initiated. Accordingly, the values displayed in the fields 225-229 are "00," while the field 231 is empty. Also, instead of displaying the value of the secondary counter, the field 233 displays a name for collectively referring to the displayed values, entitled "Run 1." Subsequent collections of displayed values, when recorded, would be entitled "Run 2," "Run 3," "Run 4," and so forth. This conveniently allows a user to record and retrieve specific measured values at a later time.

Next, in step 303, the user enters the travel distance for which the pace will be measured. With the illustrated embodiment, the user briefly holds the "adjust" command button 205 in a depressed position. The data input process 109 recognizes this activation of the "adjust" command button 205, and in response the pace calculation process 113 provides the display process 111 with travel distance data stored in the distance memory 115. As shown in FIG. 2D, the display 201 displays a portion of the travel distance data. More particularly, the display 201 provides a first field 235 containing an integral value for the travel distance, and a second field 237 containing a tenths value for the travel distance.

Initially, the value in each of these fields is "0." The value of the first field 235 blinks (represented by a dotted line in FIG. 2D), however, to indicate that a user may change the value of this field (and correspondingly the travel distance data) by activating either the start command button 207 or the stop command button 209. More particularly, each time that a user depresses the start command button 207, the value of the field 235 will increment by one whole number, and each time the user depresses the stop command button 209, the value of the field 235 will decrement by the value by one whole number. Thus, if the user depresses the start command button 207 three times, the value of the field 235 will change from "0" to "3." If the user then subsequently depresses the stop command button twice, the value of the field 235 will then decrement from "3" to "1," as shown in FIG. 2E.

Once the user has selected the desired value for the field 235, the user then activates the mode command button 203 to establish the value of the field 235 and to modify the value of the field 237. As seen in FIG. 2E, upon depression of the mode command button 203, the value of the field 235 stops blinking (represented by a solid line in the figure), and the value of the field 237 begins blinking (represented by a dotted line in the figure). As with the value of the field 237, the blinking of the value of the field 237 indicates to the user that he or she may change this value (and correspondingly the travel distance data) by depressing either the start command button 207 or the stop command button 209. Again, each depression of the start command button 207 will increment the value of the field 237 by one, while each depression of the stop command button 209 will decrement the value of the field 237 by one. Thus, depressing the start command button twice will increment the value of the field 237 from "0" to "2," as shown in FIG. 2F.

To select the unit of measurement for the desired distance, the user again depresses the mode command button 203. When the data input process 109 recognizes this activation of the mode command button 203, it prompts the display process 111 to display the unit portion of the travel distance data stored in the distance memory 115. As shown in FIG. 2G, the display 201 then provides a unit field 239 containing the currently stored unit value of the travel distance data. The value of the field 239 blinks (represented by a dotted line in this figure) to indicate that the user may change this value (and correspondingly the travel distance data) by activating either the start command button 207 or the stop command button 209. In the illustrated embodiment, each activation of either the start command button 207 or the stop command button 209 will switch the value of the field 239 from kilometers to miles and vice versa. It will be appreciated by those of ordinary skill in the art, however, that other embodiments of the invention may allow the user to select from a variety of distance units, including yards, meters, feet, or nautical miles.

Thus, by scrolling through each of fields 235-239, a user can designate travel distance data values corresponding to a distance for which a pace will be calculated. Of course, if a user wishes to change any of the values of the selected travel distance data, the user may continue to scroll through the display of any of fields 235-239 in order to go back and change the values in these fields (and thereby the corresponding values of the travel distance data). It will also be appreciated that other embodiments of the invention may employ alternate techniques for entering in travel distance data corresponding to a desired distance. For example, some embodiments may include a numeric keypad that allows a user to enter a specific number directly, rather than having to repeatedly depress a command button.

After the user has entered a desired travel distance by changing the values of the fields 235-239, the user (or an athlete being monitored by the user) then begins traveling the desired distance. Simultaneously, the user starts the primary counter of the chronographic process 107 in step 305. To activate the primary counter, the user depresses the "adjust" command button 205 again, which instructs the display process 111 to provide the chronographic fields 225-233 in display 201, as shown in FIG. 2C. To have the primary counter of the chronographic process 107 begin counting, the user subsequently activates the start command button 207. The values of the fields 225-229 will then increment as the period of time being measured elapses. With the illustrated embodiment, the secondary counter also begins counting with the primary counter, and the field 233 also increments to display the value of the secondary counter. Further, the field 231 displays a value of "1," since the total time recorded by the primary counter may be considered a "final" split time.

As the primary counter increments, the user may obtain split times without resetting the primary counter by again depressing the start command button 207. As will be appreciated by those of ordinary skill in the art, the value of fields 225-229 will briefly stop incrementing to reflect the value of the measured split time, and subsequently return to displaying the value of the counter for measuring the overall elapsed time. With some embodiments of the invention, the measured split time may be stored for later review by the user or calculations by the watch 101. In addition, the value of the field 231 will increment for each measured split time, so that the user can readily ascertain how many split times will have been measured if the primary counter is stopped. Also, the secondary counter will reset and the field 233 will change to display the new incrementing values of the secondary counter (that is, the difference between a split time currently being measured and a previously measured split time).

It should be noted that, while the above-described embodiments of the invention have the user enter the travel distance data before initiating the primary counter of the chronographic process 107, other embodiments of the invention may allow a user to designate the travel distance data while the user (or athlete being monitored by the user) is traveling the distance (that is, while the primary counter is still counting). Still other embodiments of the invention may allow a user to designate the travel distance data after the user (or athlete being monitored by the user) has finished traveling the distance (that is, after the primary counter has stopped counting).

Allowing the user to designate the travel distance data prior to starting the travel frees him or her from having to remember to designate the travel distance data after starting the travel, when the user may easily forget. Permitting the user to designate the travel distance data after starting or finishing the travel, however, advantageously allows the user to accommodate a change in the intended travel distance. This feature may useful when, for example, a runner varies his or her planned running route, or continues running after traveling the distance initially planned for the run.

As the user (or athlete being monitored by the user) finishes traveling the distance corresponding to the values of the fields 235-239, the user simultaneously stops the operation of the primary counter of the chronographic process 107 in step 307. With the illustrated embodiment, the user stops the primary counter of the chronographic process 107 from counting by activating the stop command button 209. The recorded total elapsed time is then displayed in fields 225-229. For example, if the user required 6 minutes, 54 seconds, and 52 hundredths of a second to travel a 1.2 km distance (that is, a distance corresponding to the value of the fields 235-239 shown in FIGS. 2F and 2G), then the value of the fields 225-229 shown in the display 201 will be "6"' "54"" and "52," respectively, as shown in FIG. 2H.

With the present embodiment of the invention, when the total elapsed time for traveling the desired distance has been counted, the display 201 briefly displays the recorded total elapsed time (that is, the value of the primary counter) in the fields 225-229. Additionally, in step 309, the pace calculation process 113 receives the total elapsed time from the chronographic process 107, and divides the travel distance stored in the distance memory 115 by this overall elapsed time to obtain the pace at which the distance was traveled. After this pace has been calculated, in step 311 the display process 111 displays the calculated pace in display 201.

Thus, if a user required a total elapsed time of 6'54"52 to traverse a distance of 1.2 km, the pace calculation process 113 will calculate pace of 5 minutes, 45 seconds, and 43 hundredths of a second per kilometer. This pace will then be shown in display 201. More particularly, the display 201 provides a minutes field 241 indicating the minutes for the calculated pace, a second field 243 containing a seconds value, and a hundredths of a second field 245 containing a hundredths of a second value for the pace. As will be appreciated by those of ordinary skill in the art, the display 201 for some embodiments of the invention may additionally provide an hours field containing an hours value of the pace. The hours field may be provided in addition to, or as a substitute for, the hundredths of a second field 245.

Of course, those of ordinary skill in the art will appreciate that various embodiments of the invention may provide alternate or additional options to allow a user to view a calculated pace. For example, the watch 101 may additionally provide a "data" mode, in which a user can scroll through a number of different time parameters measured for travel of a designated distance, including the pace calculated for that travel. Still other embodiments of the invention may provide pace fields for displaying a calculated pace which are continuously present in the display 201. Still other variations for displaying a calculated pace will be apparent to those of ordinary skill in the art.

Additionally, some embodiments of the invention can calculate a pace for equal segments of the travel distance after individual split times or lap times corresponding to each segment are measured during travel. With these embodiments, the pace calculation process 113 employs the split time number (displayed in the field 231) to determine the distance of the segment or segments, and divides the measured split time or lap time, which are saved, by the determined distance to calculate a pace for that segment or segments. For example, a runner may intend to run four laps around a track 0.3 km in length, and thus designate the travel distance data stored in the distance memory 115 to be 1.2 km. While running, the runner may then measure a split time at the completion of each lap, for a total of four measured split times. The chronographic process 107 will correspondingly increment the split time number to a value of "4", and stored the value of each measured split time and lap time.

The pace calculation process 113 then divides the travel distance of 1.2 km by the split time number of "4" to determine that each equal travel distance segment (that is, each lap) has a length of 0.3 km. With this segment distance, the pace calculation process 113 may then calculate a pace corresponding to each lap time and split time. For example, the pace calculation process 113 may calculate the pace for each segment by dividing the length of each segment (that is, 0.3 km) by the lap time recorded for that segment. Similarly, the pace calculation process 113 may calculate a pace corresponding to any split time by adding the distance of each segment run when the split time was taken, and dividing the sum by the split time. Thus, to obtain the pace corresponding to the third recorded split time, the pace calculation process 113 will add the length of each 0.3 km segment to obtain a sum of 0.9 km, and divide this value of 0.9 km by the value of the third recorded split time.

As will also be appreciated by those of ordinary skill in the art, other embodiments of the invention may include variations of the aspects and features of the invention described above. For example, alternate embodiments of the invention may employ other display formats to display some or all of the values discussed above. Still other embodiments may not display the calculated pace, or omit the display process 111 and the display 201 altogether. With these embodiments, the watch 101 may instead allow a user to transfer a calculated pace to another device, such as personal computer or personal digital assistant, for display. Moreover, some embodiments of the invention may omit the watch process 105 entirely.

Although the invention has been defined using the appended claims, these claims are exemplary in that the invention may include the elements and steps described herein in any combination or sub combination. Accordingly, there are any number of alternative combinations for defining the invention, which incorporate one or more elements from the specification, including the description, claims, and drawings, in various combinations or sub combinations. It will be apparent to those skilled in the relevant technology, in light of the present specification, that alternate combinations of aspects of the invention, either alone or in combination with one or more elements or steps defined herein, may be utilized as modifications or alterations of the invention or as part of the invention. It may be intended that the written description of the invention contained herein covers all such modifications and alterations. For instance, in various embodiments, a certain order to the data has been shown. However, any reordering of the data is encompassed by the present invention. Also, where certain units of properties such as size (e.g., in bytes or bits) are used, any other units are also envisioned.

What is claimed is:

1. A device for calculating a pace, comprising:
a chronograph for measuring an elapsed time;
a distance memory for storing a distance;
a pace calculation system for calculating a pace from the distance stored in the distance memory and the elapsed time measured by the chronograph;
a first button, wherein the first button functions in a chronographic mode to start measurement of the elapsed time by the chronograph and in a data mode for incrementing a value in a selected data field; and
a second button, wherein the second button functions in the chronographic mode to stop measurement of the elapsed time by the chronograph and in the data mode for decrementing the value in the selected data field.

2. The device recited in claim 1, further comprising a display for displaying the calculated pace.

3. The device recited in claim 1, further comprising a chronometer.

4. The device recited in claim 1, wherein, in the data mode, the distance is input into the distance memory using the first button to increase a value for the distance input and using the second button to decrease the value for the distance input.

5. The device recited in claim 1, wherein the chronograph, the distance memory, the pace calculation system, the first button, and the second button are incorporated into a personal digital assistant.

6. The device recited in claim 1, wherein the chronograph, the distance memory, the pace calculation system, the first button, and the second button are incorporated into a watch.

7. The device recited in claim 6, wherein the watch is a wristwatch.

8. The device recited in claim 1, further including a memory for storing the calculated pace.

9. The device recited in claim 1, further comprising:
a third button that, when activated, allows switching between different modes of operation.

10. The device recited in claim 9, wherein the different modes of operation include at least a time mode, the chronographic mode, and the data mode.

11. The device recited in claim 9, further comprising:
a fourth button that, when activated, scrolls through a data field.

12. The device recited in claim 9, further comprising:
a fourth button that, when activated, clears stored content in a data field.

13. The device recited in claim 1, further comprising:
a third button that, when activated, scrolls through a data field.

14. The device recited in claim 1, further comprising:
a third button that, when activated, clears stored content in a data field.

15. A device for calculating a pace, comprising:
a chronograph for measuring an elapsed time;
a distance memory for storing a distance;
a pace calculation system for calculating a pace from the distance stored in the distance memory and the elapsed time measured by the chronograph;
a first button, wherein the first button allows for selection of a mode of operation among at least a chronographic mode for operating the chronograph and a data mode for inputting data;
a second button, wherein the second button functions in the chronographic mode to start measurement of the elapsed time by the chronograph and in the data mode for incrementing a value in a selected data field; and
a third button, wherein the third button functions in the chronographic mode to stop measurement of the elapsed time by the chronograph and in the data mode for decrementing the value in the selected data field.

16. The device recited in claim 15, further comprising a display for displaying the calculated pace.

17. The device recited in claim 15, wherein the chronograph, the distance memory, the pace calculation system, the first button, the second button, and the third button are incorporated into a personal digital assistant.

18. The device recited in claim 15, wherein the chronograph, the distance memory, the pace calculation system, the first button, the second button, and the third button are incorporated into a watch.

19. The device recited in claim 18, wherein the watch is a wristwatch.

20. The device recited in claim 15, further including a memory for storing the calculated pace.

21. The device recited in claim 15, further comprising:
a fourth button that, when activated, scrolls through a data field.

22. The device recited in claim 15, further comprising:
a fourth button that, when activated, clears stored content in a data field.

* * * * *